US011970925B2

(12) United States Patent
King et al.

(10) Patent No.: US 11,970,925 B2
(45) Date of Patent: Apr. 30, 2024

(54) DEVICE AND METHOD FOR GAS LIFT OF A RESERVOIR FLUID

(71) Applicant: TIER 1 ENERGY TECH, INC., Edmonton (CA)

(72) Inventors: Jeff King, Edmonton (CA); Jeffrey Golinowski, Edmonton (CA)

(73) Assignee: Tier 1 Energy Solutions, Inc., Edmonton (CA)

( * ) Notice: Subject to any disclaimer, the term of this patent is extended or adjusted under 35 U.S.C. 154(b) by 2 days.

(21) Appl. No.: 17/449,210

(22) Filed: Sep. 28, 2021

(65) Prior Publication Data

US 2022/0098960 A1 Mar. 31, 2022

Related U.S. Application Data

(60) Provisional application No. 63/085,920, filed on Sep. 30, 2020.

(51) Int. Cl.
*E21B 43/12* (2006.01)

(52) U.S. Cl.
CPC ..... *E21B 43/122* (2013.01)

(58) Field of Classification Search
CPC ..... E21B 43/122; E21B 43/121; E21B 43/13
See application file for complete search history.

(56) References Cited

U.S. PATENT DOCUMENTS 4,335,786 A 6/1982 Smith
5,105,889 A * 4/1992 Misikov ..... E21B 43/124 166/372
5,427,504 A 6/1995 Dinning et al.
6,059,040 A 5/2000 Levitan et al.
6,725,916 B2 4/2004 Gray et al.
7,210,532 B2 5/2007 Sherwood et al.
(Continued)

FOREIGN PATENT DOCUMENTS

CA 2860559 2/2015
CA 2847341 9/2015
(Continued)

OTHER PUBLICATIONS

Ansari, A. M., Sylvester, N. D., Sarica, C., Shoham, O., and J. P. Brill. "A Comprehensive Mechanistic Model for Upward Two-Phase Flow in Wellbores." SPE Prod & Fac 9 (1994): 143-151. doi: https://doi.org/10.2118/20630-PA.
(Continued)

*Primary Examiner* — George S Gray
(74) *Attorney, Agent, or Firm* — Bennett Jones LLP

(57) ABSTRACT

A method, related device and system for lifting a reservoir fluid in an oil and gas well involves allowing the reservoir fluid to flow in an axial uphole direction through an internal flow path of a production tubing disposed in the well. The internal flow path includes a Venturi profile configured to flash out a free gas phase from the reservoir fluid as the reservoir fluid flows in the axial uphole direction through the Venturi profile, such that the reservoir fluid comprises the free gas phase and a liquid phase. The internal flow path also includes a diffusion profile disposed above the Venturi profile and configured to condense the free gas phase into the liquid phase as the reservoir fluid flows in axial uphole direction through the diffusion profile.

8 Claims, 11 Drawing Sheets

(56) References Cited

U.S. PATENT DOCUMENTS

| | | | | |
|---|---|---|---|---|
| 10,253,611 | B2 | 4/2019 | Saponja et al. | |
| 2003/0155129 | A1 | 8/2003 | Gray et al. | |
| 2006/0213652 | A1* | 9/2006 | Shaposhnikov | E21B 43/121 166/372 |
| 2006/0225886 | A1* | 10/2006 | Johnson | E21B 43/124 166/105 |
| 2007/0221383 | A1 | 9/2007 | Mason et al. | |
| 2012/0080196 | A1 | 4/2012 | Laing et al. | |
| 2014/0216753 | A1 | 8/2014 | Smith et al. | |
| 2015/0075772 | A1 | 3/2015 | Saponja et al. | |
| 2015/0267519 | A1 | 9/2015 | Saponja et al. | |
| 2015/0267523 | A1 | 9/2015 | Saponja et al. | |
| 2016/0265332 | A1 | 9/2016 | Saponja et al. | |
| 2017/0010787 | A1 | 1/2017 | Ranganathan et al. | |
| 2017/0130573 | A1 | 5/2017 | Saponja et al. | |
| 2018/0087367 | A1 | 3/2018 | Saponja et al. | |
| 2018/0100384 | A1 | 4/2018 | Saponja et al. | |
| 2018/0112508 | A1 | 4/2018 | Saponja et al. | |
| 2018/0112509 | A1 | 4/2018 | Saponja et al. | |
| 2018/0223643 | A1 | 8/2018 | Saponja et al. | |
| 2018/0283155 | A1 | 10/2018 | Saponja et al. | |
| 2018/0306019 | A1 | 10/2018 | Saponja et al. | |
| 2018/0306020 | A1 | 10/2018 | Saponja et al. | |
| 2019/0024491 | A1* | 1/2019 | Fielder | F04D 9/007 |
| 2021/0254435 | A1* | 8/2021 | Zhu | E21B 43/12 |

FOREIGN PATENT DOCUMENTS

| | | |
|---|---|---|
| CA | 2847446 | 9/2015 |
| CA | 2943408 | 10/2015 |
| CA | 3026427 | 6/2019 |
| CA | 3032720 | 8/2019 |
| WO | 2015035509 | 3/2015 |

OTHER PUBLICATIONS

Aidoun, Z. K. Ameu, M. Falsafioon and M. Badache, "Current Advances in Ejector Modelling Experimentation and Applications for Refrigeration and Heat Pumps. Part 2: Two-Phase Ejectors," Modern Grinding Technology and Systems: Inventions, pp. 3-5, 2019.

R. Miller, "ASME PTC-6 Nozzle," in Flow Measurement Engineering Handbook, 1989, pp. 61-63.

D. Barnea,A unified model for predicting flow-pattern transitions for the whole range of pipe inclinations,International Journal of Multiphase Flow, vol. 13, Issue 1,1987, pp. 1-12.

C-FER Technologies, "PC-PUMP [Computer Software]," 2017. [Online], Available: www.pc-pump.com.

Oli Systems Inc, "Oli Studio 9.6 [Computer Software]," 2019.

ANSYS, "CFX 18.0," 2018.

* cited by examiner

DEVICE AND METHOD FOR GAS LIFT OF A RESERVOIR FLUID

CROSS-REFERENCE TO RELATED APPLICATION

This application claims the priority benefit of U.S. provisional patent application No. 63/085,920 filed on Sep. 30, 2020, the entire contents of which are hereby incorporated by reference in this application.

FIELD OF THE INVENTION

The present invention relates to lifting reservoir fluid in the production tubing of an oil and gas well.

BACKGROUND OF THE INVENTION

Artificial lift technologies are used to enhance the production rate of a reservoir fluid from an oil and gas well, particularly when the prevailing natural reservoir pressure is insufficient to lift the reservoir fluid in the downhole production tubing to the well head.

A gas lift valve or mandrel may be installed in a side pocket of the production tubing. A surface pump injects gas under high pressure from a surface source into the annular space between the production tubing and the well wall. The gas enters the production tubing via the gas lift valve in the form of bubbles. The bubbles mix with the reservoir fluid in the production tubing such that the resulting mixture has a lower density that the reservoir fluid. The relatively buoyant bubbles may also provide a "scrubbing" effect that helps lift the reservoir fluid in the production tubing.

A jet pump may be installed in a production tubing. A surface pump injects a power fluid into the annular space between the production tubing and the well wall. The power fluid enters the jet pump through side openings of the production tubing and flows through an internal nozzle of the jet pump to create a low fluid pressure zone that draws reservoir fluid up a lower portion of the production tubing. The reservoir fluid commingles with the power fluid, and flows up the production tubing. Alternatively, the surface pump may inject power fluid into a downhole tube, such that the commingled fluid flows up the annular space.

These artificial lift technologies require equipment to supply external energy to supplement the natural reservoir pressure, which adds cost and complexity to the well system. Accordingly, there remains a need in the art for technology to lift reservoir fluid in an oil and gas well without the need for such equipment.

SUMMARY OF THE INVENTION

In one aspect, the present invention comprises a method for lifting a reservoir fluid in an oil and gas well. The method comprises the step of allowing the reservoir fluid to flow in an axial uphole direction through an internal flow path of a production tubing disposed in the well. The internal flow path comprises a "Venturi profile" having a transverse cross-sectional area that gradually decreases in the axial uphole direction to a throat. The Venturi profile is configured to flash out a free gas phase from the reservoir fluid as the reservoir fluid flows in the axial uphole direction through the Venturi profile, such that the reservoir fluid comprises the free gas phase and a liquid phase. The internal flow path further comprises a "diffusion profile" disposed above the throat of the Venturi profile, and having a transverse cross-sectional area that gradually increases in the axial uphole direction. The diffusion profile is configured to condense the free gas phase into the liquid phase as the reservoir fluid flows in the axial uphole direction through the diffusion profile. In embodiments of the method, pressure of the reservoir fluid in the internal flow path is not increased by energy added from any man-made equipment. In embodiments of the method, the internal flow path is configured such that the reservoir fluid has a pressure at a location above the throat that is sufficient to lift the reservoir fluid to a surface location of the well.

In another aspect, the present invention comprises a device for lifting a reservoir fluid in an oil and gas well. The device comprises a tubular member for forming a portion of a production tubing disposed in the well. The tubular member defines an internal flow path for flow of the reservoir fluid. The internal flow path extends in an axial uphole direction from at least one lower inlet port to an upper outlet port. The internal flow path comprises a Venturi profile and a diffusion profile, as described above.

In another aspect, the present invention comprises a system for lifting a reservoir fluid in an oil and gas well. The system comprises a production tubing disposed in the well and defining an internal flow path for flow of the reservoir fluid. The internal flow path extends in an axial uphole direction form at least one lower inlet port. The internal flow path comprises a Venturi profile and a diffusion profile, as described above.

In embodiments of the method, device, and system of the present invention (as described above), the at least one lower inlet port may comprise a plurality of lower inlet ports. In embodiments, the plurality of lower inlet ports may be transversely spaced apart from each other. In embodiments, the at least one inlet port has an axial length to transverse dimension ratio of at least about 9 to 1. In embodiments, the internal flow path further comprises an inlet chamber profile disposed axially between the at least one inlet port and the Venturi profile, and having a transverse cross-sectional area that gradually decreases in the axial uphole direction. In embodiments, the tubular member of the device, or the production tubing of the system comprises: a housing; an inlet chamber section removably retained in the housing and defining a first portion of the internal flow path comprising the Venturi profile; and a throat section removably retained in the housing and defining a second portion of the internal flow path comprising the diffusion profile.

The present invention may be used to enhance production of the reservoir fluid from the oil and gas well, solely under the influence of natural reservoir pressure—that is, without the need for equipment supplying external energy. The flashing out of the free gas reduces the density of the reservoir fluid in a region above the Venturi profile, and at a well depth below which the gas would naturally flash out of the reservoir fluid. This reduces the hydrostatic head of the column of reservoir fluid in the production tubing, and thereby provides a gas-lift effect.

The condensing of the free gas into the liquid phase may help to maintain the pressure of the reservoir fluid for flow to the well head, such that the gas-lift effect is minimally impacted or not impacted by the free gas in the internal flow path.

BRIEF DESCRIPTION OF THE DRAWINGS

In the drawings, which form part of the specification, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

FIG. 4 is a first alternative embodiment. FIG. 5 is a second alternative embodiment. FIG. 6 is a third alternative embodiment. FIG. 7 is a fourth alternative embodiment.

FIG. 8A shows the entire throat section. FIG. 8B shows region 'I' of FIG. 8A.

FIG. 9A shows the entire throat section. FIG. 9B shows region 'I' of FIG. 9A.

FIG. 11A shows the reservoir fluid velocity and streamlines. FIG. 11B shows the reservoir fluid pressure. FIG. 11C shows the reservoir fluid gas volume fraction. FIG. 11D shows the reservoir fluid density.

DETAILED DESCRIPTION OF EMBODIMENTS OF THE INVENTION

The present invention relates to lifting reservoir fluid in an oil and gas well. Any term or expression not expressly defined herein shall have its commonly accepted definition understood by a person skilled in the art.

Figure 1:
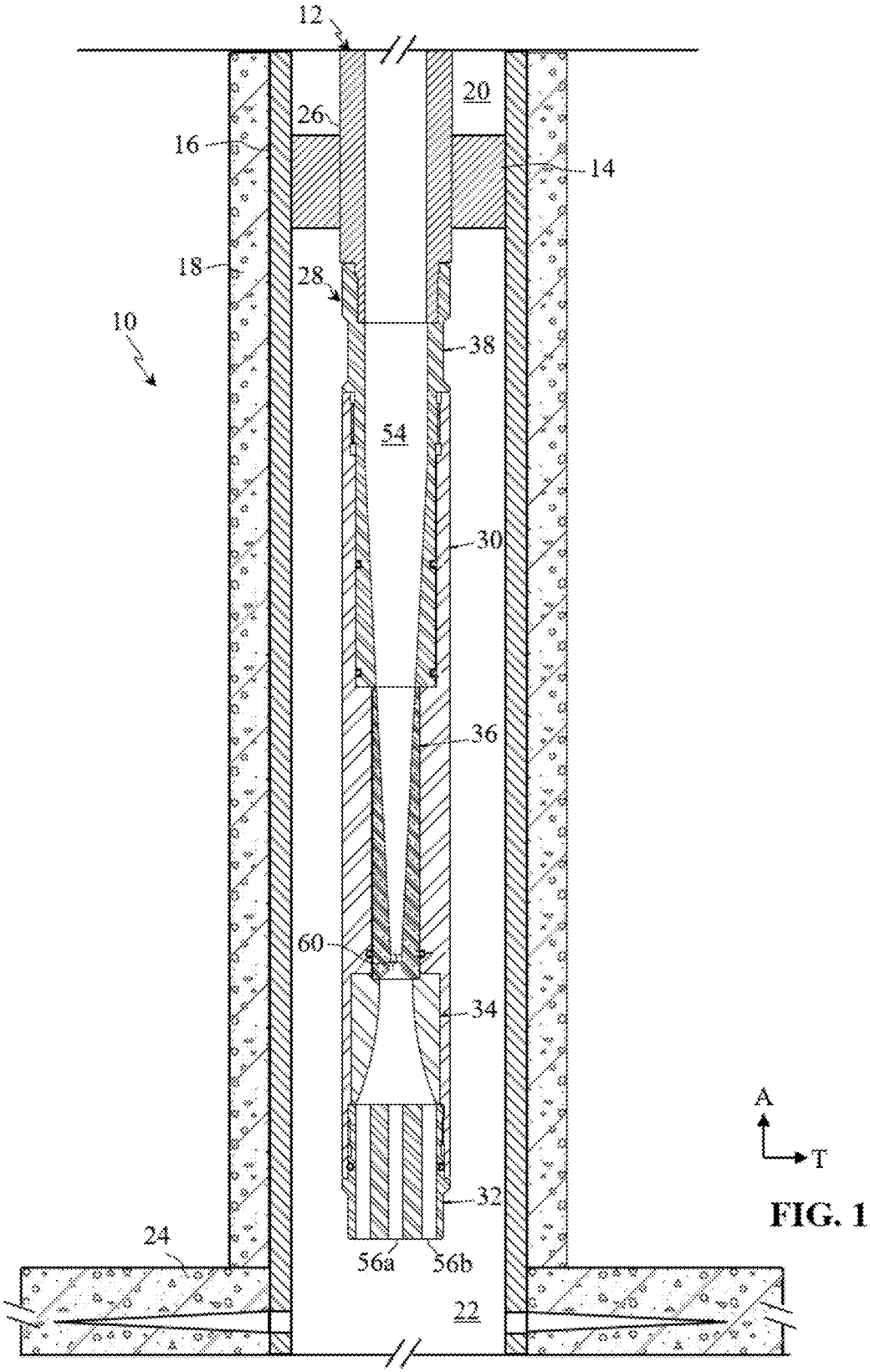
FIG. 1 shows an axial medial cross-sectional view of an embodiment of a system of the present invention for lifting a reservoir fluid in an oil and gas well.

System for Gas Lift. FIG. 1 shows an embodiment of system 10 of the present invention including production tubing 12 and sealing element 14, disposed within an oil and gas well with a wall formed by casing 16 (or alternatively by geological formation 18 if the well were uncased). Axis "A" denotes the "axial" direction parallel to the central axis of the well and production tubing 12, which is vertical in the drawing plane of FIG. 1. Axis "T" denotes a "transverse" direction perpendicular to the axial direction, which is horizontal in the drawing plane of FIG. 1.

Production tubing 12 extends axially upwardly to convey reservoir fluid to a well head (not shown) at the ground surface. Sealing element 14 (e.g., a packer) seals the annular space between production tubing 12 and casing 16, thus dividing the well into an upper well portion 20 and a lower well portion 22. Casing 16 is perforated to allow reservoir fluid of producing zone 24 to enter lower well portion 22.

Production tubing 12 includes an upper portion 26 and a lower portion formed by device 28 of the present invention. Device 28 forms the lower terminus of production tubing 12 in this embodiment; production tubing 12 may extend below device 28 in other embodiments. Thus, it will be understood that "upper" and "lower" describe relative axial positions of portion 26 and device 28 of production tubing 12, and do not indicate axial extremities of production tubing 12.

Figure 2:
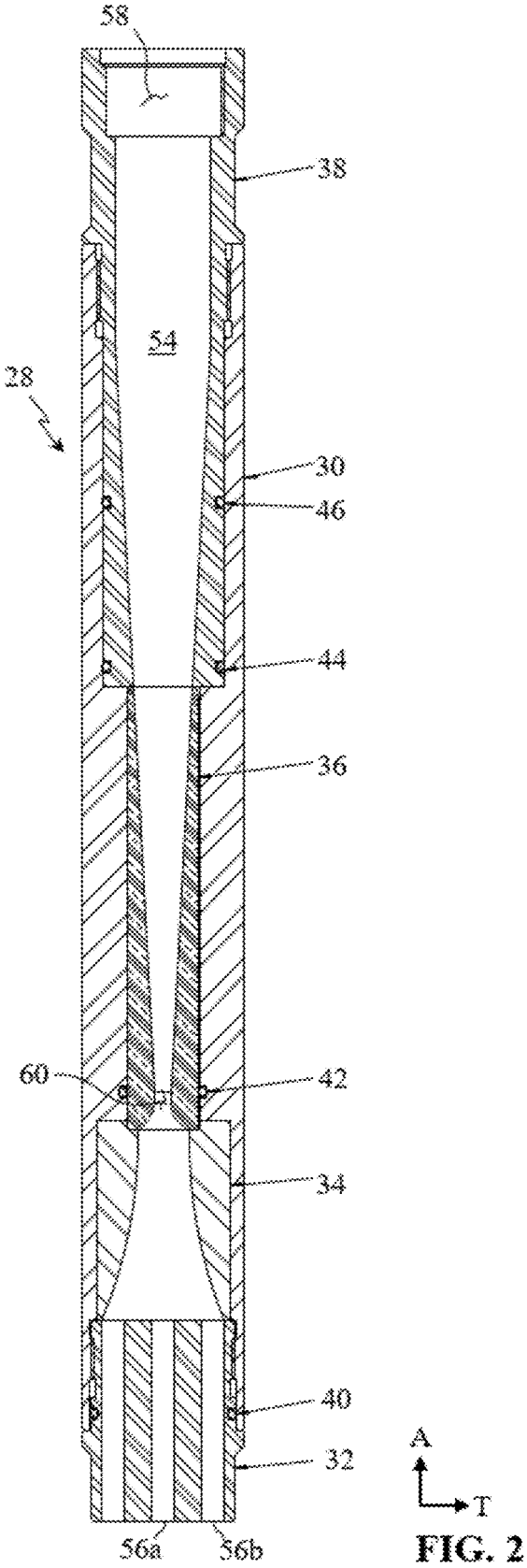
FIG. 2 shows an axial medial cross-sectional view of an embodiment of a device installed in the system of FIG. 1, when isolated from the system.
Figure 3:
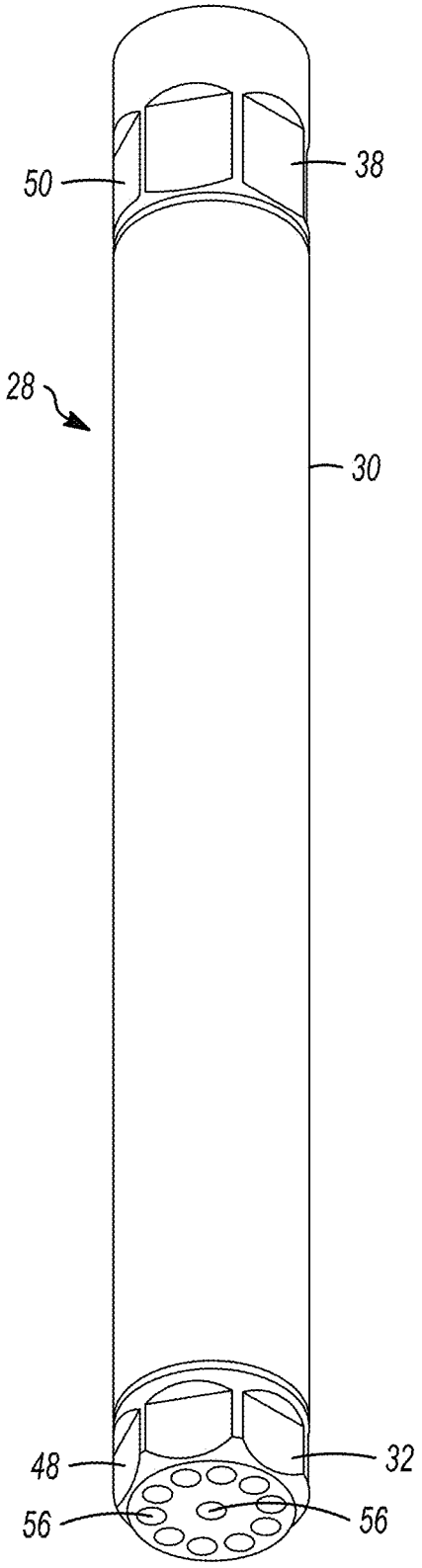
FIG. 3 shows a perspective view of the device of FIG. 2.

Device. FIGS. 2 and 3 show device 28 in isolation. Device 28 includes a tubular member formed in this embodiment from a housing 30, inlet port section 32, inlet chamber section 34, throat section 36, and diffuser chamber section 38. These separate parts facilitate manufacturing of device 28, and servicing and modification of device 28. For example, different embodiments of sections 32, 34, 36, 38 may be interchanged with a single housing 30 to modify flow characteristics of the tubular member for different well conditions. These parts of the tubular member may be made of a corrosion-resistant alloy steel, or any other material suitable for conditions in the well. The tubular member may be formed by a single monolithic part in other embodiments.

The embodiment of device 28 shown in FIG. 2 is assembled by inserting inlet chamber section 34 up into housing 30 to abut against a lower internal shoulder thereof. Inlet port section 32 is secured to housing 30 by a threaded connection. Throat section 36 is inserted down into housing 30 to abut against the upper end of inlet chamber section 34. Diffuser chamber section 38 is secured to housing 30 by a threaded connection. Diffuser chamber section 38 defines a threaded box end for attachment to upper portion 26 of production tubing 12 (see FIG. 1). O-ring seals 40, 42, 44, 46 seal between inner wall of housing 30 and outer walls of sections 32, 34, 36, and 38. Threaded connections of sections 32 and 38 with housing 30 are tightened using wrenches applied to flats 48, 50 formed on sections 32, 38, respectively (see FIG. 3). For scale, in this embodiment, the tubular member has an axial length of about 16.66 inches and a transverse outer diameter of about 1.84 inches.

Internal flow path. The tubular member defines axial internal flow path 54 for the reservoir fluid. Internal flow path 54 extends in the axial uphole direction from at least one lower inlet port 56 to upper outlet port 58. Lower inlet ports 56 allow reservoir fluid in lower well portion 22 to flow into internal flow path 54. Upper outlet port 58 allows reservoir fluid in internal flow path 54 to flow into upper portion 26 of production tubing 12. In this embodiment, lower inlet ports 56 extend axially up from the lower terminus of the tubular member; in other embodiments, lower inlet ports 56 may extend transversely inward from a side wall of the tubular member, in which case the tubular member may extend below lower inlet ports 56. Thus, it will be understood that "lower" describes an axial position of inlet ports 56 relative to upper outlet port 58, and does not indicate a lower extremity of the tubular member.

Inlet port section. In the embodiment shown in FIG. 2, inlet port section 32 defines a central lower inlet port 56*a* substantially coinciding transversely with the central axis of inlet port section 32, which is surrounded by ten peripheral lower inlet ports 56*b* arranged in a circle in a transverse cross-section of inlet port section 32 (see FIG. 3). Each lower inlet port 56 has an aspect ratio of at least about 9 to 1, as defined by the ratio of its axial length (about 2.28 inches) to its transverse dimension (i.e., diameter of about 0.25 inches). This configuration and proportion of inlet ports 56 may allow for an evenly distributed flow of reservoir fluid, with minimal vorticity within inlet chamber section 34. In other embodiments, inlet port section 32 may define a different number of lower inlet ports 56, with a different geometry and arrangement.

Inlet chamber section. Inlet chamber section 34 defines an inlet chamber profile that has an inner diameter that gradually decreases in the axial direction from inlet port section 32 to throat section 36. Inlet chamber section 34 may help to minimize vorticity and flow separation of the reservoir fluid as it flows in the axial uphole direction toward throat section 36.

In this embodiment, inlet chamber section 34 is closed to flow of any fluid, except for reservoir fluid that enters from lower well portion 22 via lower inlet ports 56. The lower inlet ports 26 are the only openings defined by the tubular member of device 28 that permit fluid communication into internal flow path 54 below the Venturi profile of throat section 36, as described below. Accordingly, the reservoir fluid does not commingle with any other fluid as it flows up toward the Venturi profile of throat section 36.

In the embodiment shown in FIG. 2, inlet chamber section 34 has an axial length of about 2.25 inches. The inner wall of inlet chamber section 34 transitions from an inlet diameter of about 1.4 inches to an outlet diameter of about 0.58 inches according to quadratic curve of the form '$y=ax^2+bx+c$', where 'x' and 'y' are axial and transverse coordinates, respectively, and 'a', 'b', and 'c' are coefficients. The upper end of inlet chamber section 34 defines a recess that receives the lower end of throat section 36, allowing inlet chamber section 34 to be used with throat sections 36 of different inner diameters at their lower ends.

Figure 4:
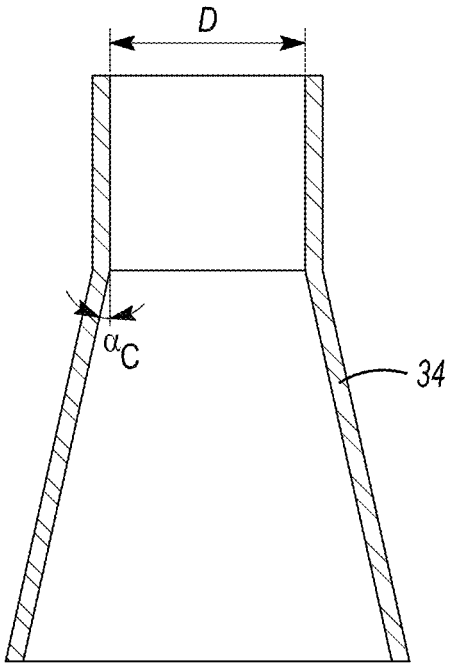
FIGS. 4 to 7 show axial medial cross-sectional views of alternative embodiments of the inlet chamber section for the device of FIG. 2.

FIGS. 4 to 7 show alternative embodiments of inlet chamber section 34 that are interchangeable with the embodiment shown in FIG. 2. The embodiments have the same axial length of 2.25 inches and maximum inner diameter of about 1.4 inches as the embodiment shown in FIG. 2. In FIG. 4, inner wall of inlet chamber section 34 defines a lower frustro-conical portion with an axial length of about 1.5 inches, and an upper cylindrical portion with an axial length and inner diameter of about 0.75 inches. The upper cylindrical portion may help to minimize vorticity below throat section 36.

Figure 5:
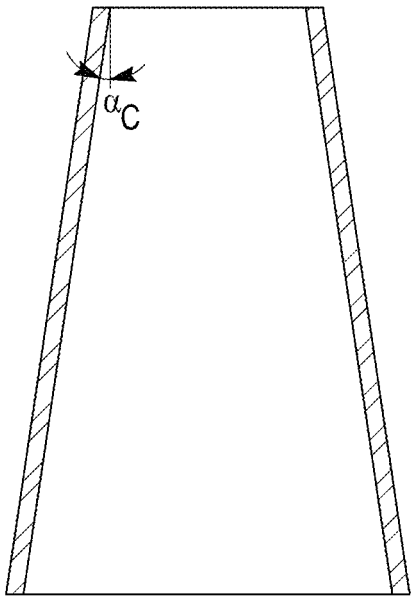

In FIG. 5, inner wall of inlet chamber section 34 is entirely conical, thus avoiding the angular change of the inner wall of the embodiment shown in FIG. 4.

Figure 6:
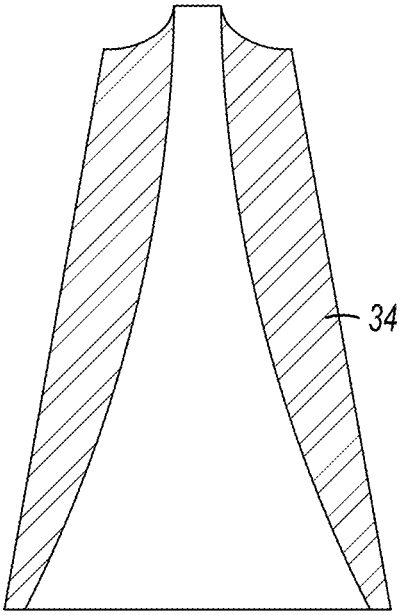
Figure 8A:
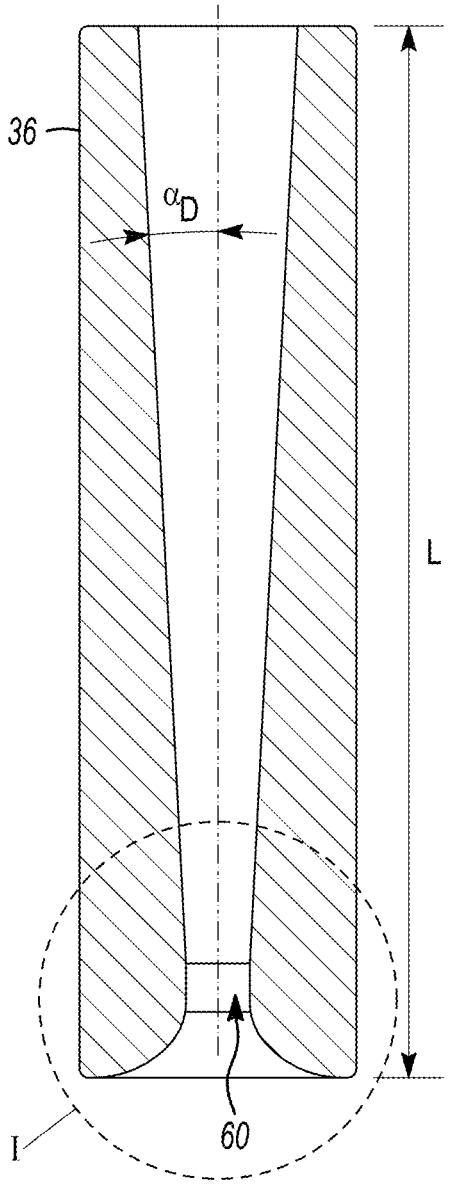
FIGS. 8A and 8B show axial medial cross-sectional views of a first embodiment of a throat section for the device of FIG. 2.
Figure 8B:
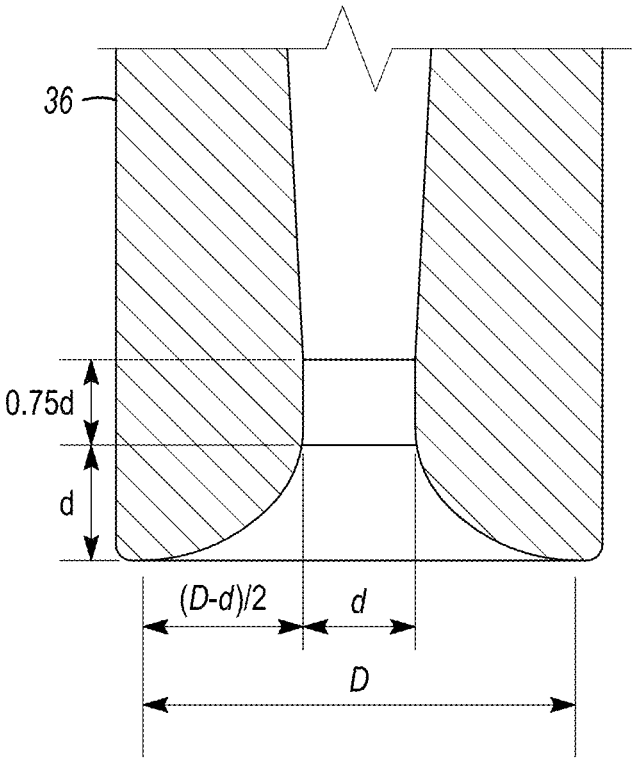

In FIG. 6, inlet chamber section 34 is adapted specifically for use with the embodiment of throat section 36 shown in FIGS. 8A and 8B. The upper end of inlet chamber section 34 is complementary in shape to the lower end of throat section 36 shown in FIG. 8A. Further, inlet chamber section 34 has an inner diameter of 0.75 inches at its upper outlet that matches the inlet diameter 'D' of throat section 36 shown in FIG. 8B. Accordingly, when the upper end of inlet chamber section 34 and the lower end of throat section 36 abut against each other, internal flow path 54 transitions smoothly between sections 34, 36 without any abrupt change of angle or inner diameter.

Figure 7:
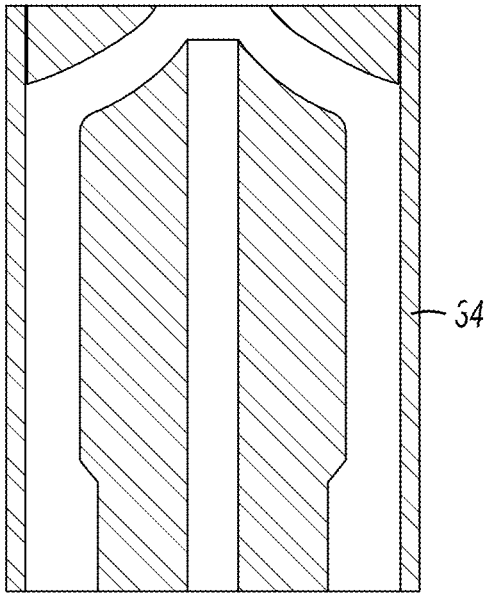

In FIG. 7, inlet chamber section 34 includes a central element defining a central channel for transverse alignment with central lower inlet port 56*a* defined by inlet port section 32. The central element and inner wall of inlet chamber section 34 define therebetween a plurality of peripheral channels for transverse alignment with a different one of peripheral lower inlet ports 56*b* defined by inlet port section 32 (see FIGS. 2 and 3). At the upper end of inlet chamber section 34, the central channel and peripheral channels converge to a single nozzle-like outlet.

Throat section. Throat section 36 defines a Venturi profile for flashing out a free gas phase of the reservoir fluid. "Venturi profile" refers to the transverse cross-sectional area of internal flow path 54 gradually decreasing in the uphole axial direction toward throat 60. In accordance with Bernoulli's principle, when an incompressible reservoir fluid flows at a steady state through the Venturi profile, the reservoir fluid velocity is higher and the reservoir fluid pressure is lower in a region at and above throat 60, than in the region immediately below throat 60.

Figure 10A:
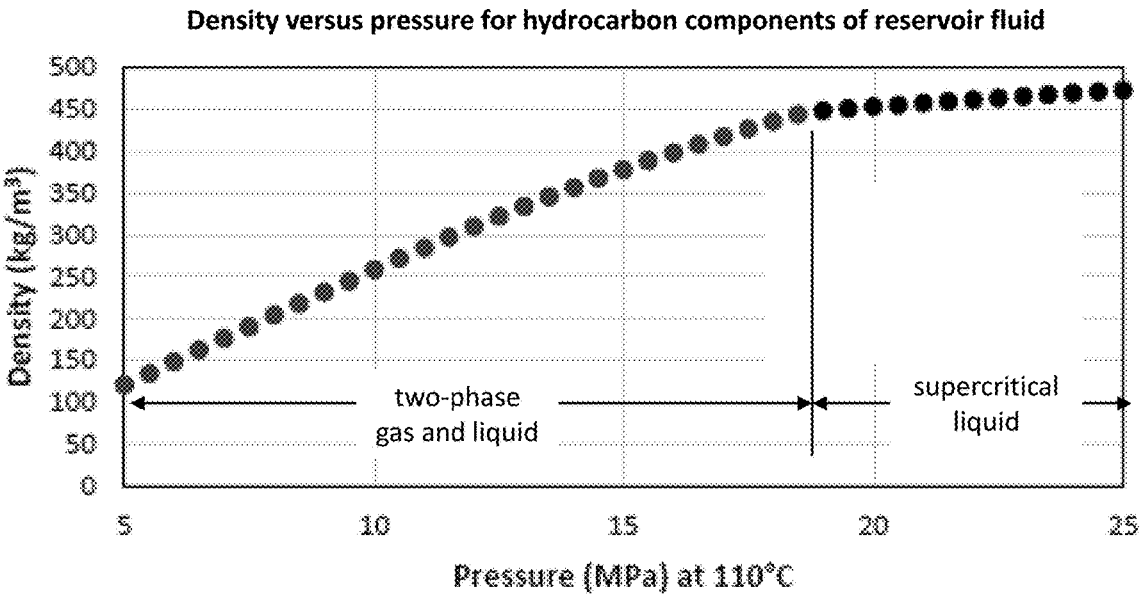
FIG. 10A shows an example of a relationship between density and pressure of hydrocarbon components of a reservoir fluid, used in a computational fluid dynamics (CFD) model.

"Flash out" refers to a fraction of the hydrocarbon components of the reservoir fluid transforming from a higher density supercritical liquid phase to a lower density free gas phase, resulting in the reservoir fluid having both a liquid phase and a free gas phase. FIG. 10A shows an example of a model relationship between density and pressure of a mixture of hydrocarbon components in a typical reservoir fluid from a well in the Duvernay Formation in western Alberta, Canada. At higher pressures, the reservoir fluid is a single supercritical liquid phase. As the reservoir fluid pressure decreases to about 18.0 MPa (gauge) in this example, some of the lighter (i.e., lower molecular weight) hydrocarbon components vaporize, and the reservoir fluid transforms into a two-phase fluid including a free gas phase and a liquid phase. The pressure at which this phase transition occurs will vary depending on the hydrocarbon components present and their relative proportions within the reservoir fluid.

Returning to FIG. 8A, above the Venturi profile, throat section 36 also defines a diffusion profile for condensing the free gas into the liquid phase of the reservoir fluid. "Diffusion profile" refers to the transverse cross-sectional area of internal flow path 54 gradually increasing in the uphole axial direction away from throat 60. As the reservoir fluid flows at a steady state through the diffusion profile, the reservoir fluid velocity gradually decreases, and the reservoir fluid pressure gradually increases in the uphole axial direction sufficiently to condense the free gas phase back to the liquid phase.

The Venturi profile and diffusion profile may be configured by persons of ordinary skill in the art to achieve the below objectives, by appropriate selection of dimensional parameters such as axial length 'L', diffusing angle '$a_D$', throat diameter 'd' and inlet diameter 'D' (see FIGS. 8A to 9B). The Venturi profile below throat 60 should limit the reservoir fluid pressure drop so that the reservoir fluid has sufficient energy to flow through throat 60 without choking. Throat 60 should result in a reservoir fluid pressure drop that is effective to "flash out" a free gas phase from the reservoir fluid. In this regard, a phase-pressure relationship such as shown in the example of FIG. 10A will indicate the "flash out" pressure for a particular reservoir fluid, which may be used for the design of the Venturi profile. The diffusion profile above throat 60 should allow for gradual recovery of reservoir fluid pressure, sufficient to condense the free gas phase back into the liquid phase, and to maintain a sufficient production rate of the reservoir fluid in production tubing 12.

As an example, in the embodiment shown in FIGS. 2, 8A, and 8B, throat section 36 has an axial length 'L' of about 4.44 inches, and a diffusing angle '$a_D$' of about 3°. The inner wall of throat section 36 transitions from inlet diameter 'D' of about 0.75 inches to throat diameter 'd' of about 0.185 inches according to ellipsoidal function, over an axial inlet distance equal to throat diameter 'd'.

Figure 9A:
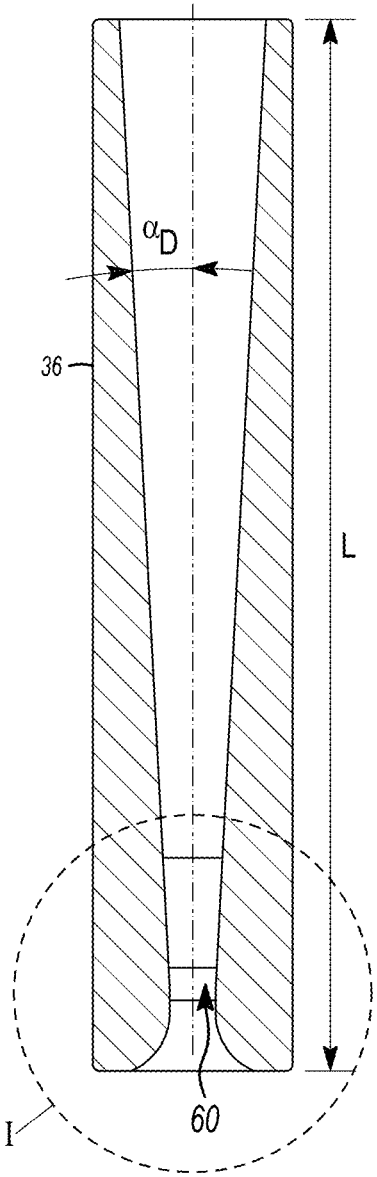
FIGS. 9A and 9B show axial medial cross-sectional views of a second embodiment of a throat section for the device of FIG. 2.
Figure 9B:
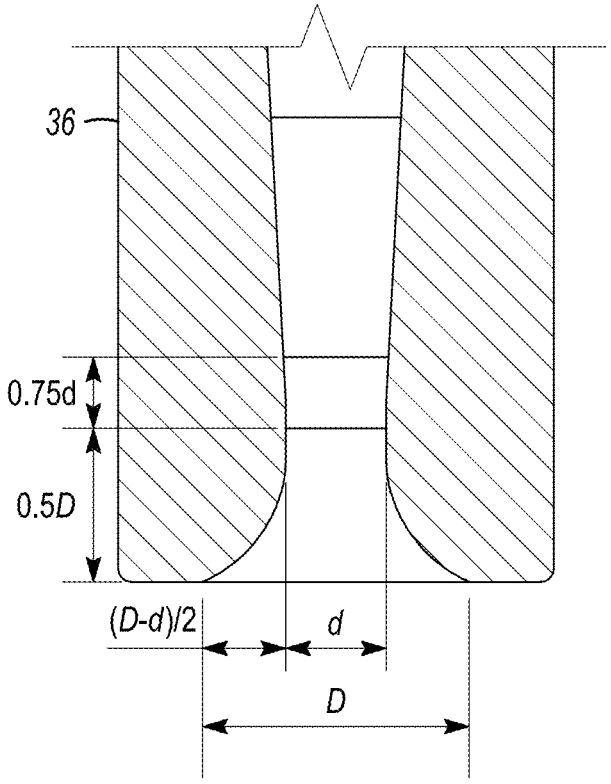

As another example, in the alternative embodiment shown in FIGS. 9A and 9B, throat section 36 has the same axial length 'L', diffusing angle '$a_D$', and throat diameter 'd' as the embodiment shown in FIGS. 8A and 8B, but a smaller inlet diameter 'D' of about 0.58 inches, and a longer axial inlet distance of 0.5 times the inlet diameter 'D', for a less abrupt curvature and longer axial transition to throat 60.

Diffuser chamber section. Diffuser chamber section 38 continues the diffusion profile defined in part by throat section 36. Accordingly, diffuser chamber section 38 has an inner diameter that gradually increases in the axial direction from throat section 36 to upper outlet port 58. Preferably, diffuser chamber section 38 allows for a flow of reservoir fluid with minimal vorticity and flow separation as the reservoir fluid flows toward upper outlet port 58.

Method for Gas Lift. Device 28 may be used in a method to lift a reservoir fluid in an oil and gas well. The method may be used to produce the reservoir fluid from the well under "natural reservoir pressure"—i.e., the pressure of the reservoir fluid is not supplemented by energy added from any man-made equipment such as a pump.

Referring to FIG. 1, device 28 is attached to upper portion 26 of production tubing 12 with sealing element 14 in an unexpanded state. Production tubing 12 is lowered into casing 16, until lower inlet ports 56 are in the vicinity of producing zone 24. Sealing element 14 is expanded to seal against casing 16 as shown in FIG. 1. Reservoir fluid from producing zone 24 flows through perforations of casing 16 into lower well portion 22. Under influence of natural reservoir pressure, reservoir fluid flows through lower inlet ports 56 of device 28 into internal flow path 54.

Figure 10B:
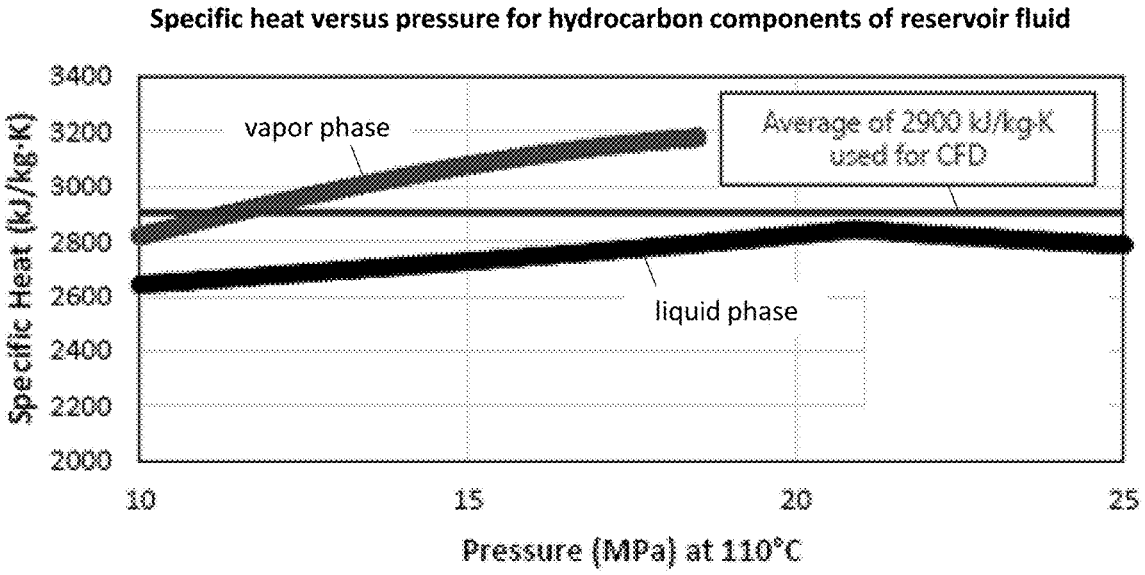
FIG. 10B shows an example of a relationship between specific heat and pressure of hydrocarbon components of a reservoir fluid, including an average specific heat used in a computational fluid dynamics (CFD) model.

A computational fluid dynamics (CFD) model of the embodiment of the device 28 shown in FIG. 2 predicts a "gas-lift" effect as the reservoir fluid flows at a steady state through internal flow path 54. ANSYS CFX 18.0 (2018)™ software was used to model internal flow path 54 using a finite element approach. OLI Studio 9.6™ software was used to model the reservoir fluid as a continuous (i.e., without bubbles) multiphase fluid of emulsion (liquid condensate of hydrocarbons), water (brine), and gas (gaseous hydrocarbons), with pressure-dependent density for water (brine), and for hydrocarbon components according to the relationship shown in FIG. 10A, and an assumed average specific heat of 2900 kJ/[kg·K] for hydrocarbon components based on the relationship shown in FIG. 10B. The modeled reservoir fluid has a flash point pressure of about 18.0 MPa (gauge) at 100° C., at which lighter hydrocarbon components "flash out." The boundary conditions (i.e., depth dependent temperature and pressure) were selected to simulate conditions expected in a well in the Montney Formation of Alberta and British Columbia, Canada. The flow bottom hole pressure (FBHP) was set at 18.5 MPa at lower inlet ports 56 of device 28 assuming an installation depth of about 3157 meters. The bulk mass flow rate of reservoir fluid was set at 0.658 kg/s with a water-to-oil ratio (WOR) of 0.067. The pressure of the separator at the well head was set to 5 MPa.

Figure 11A:
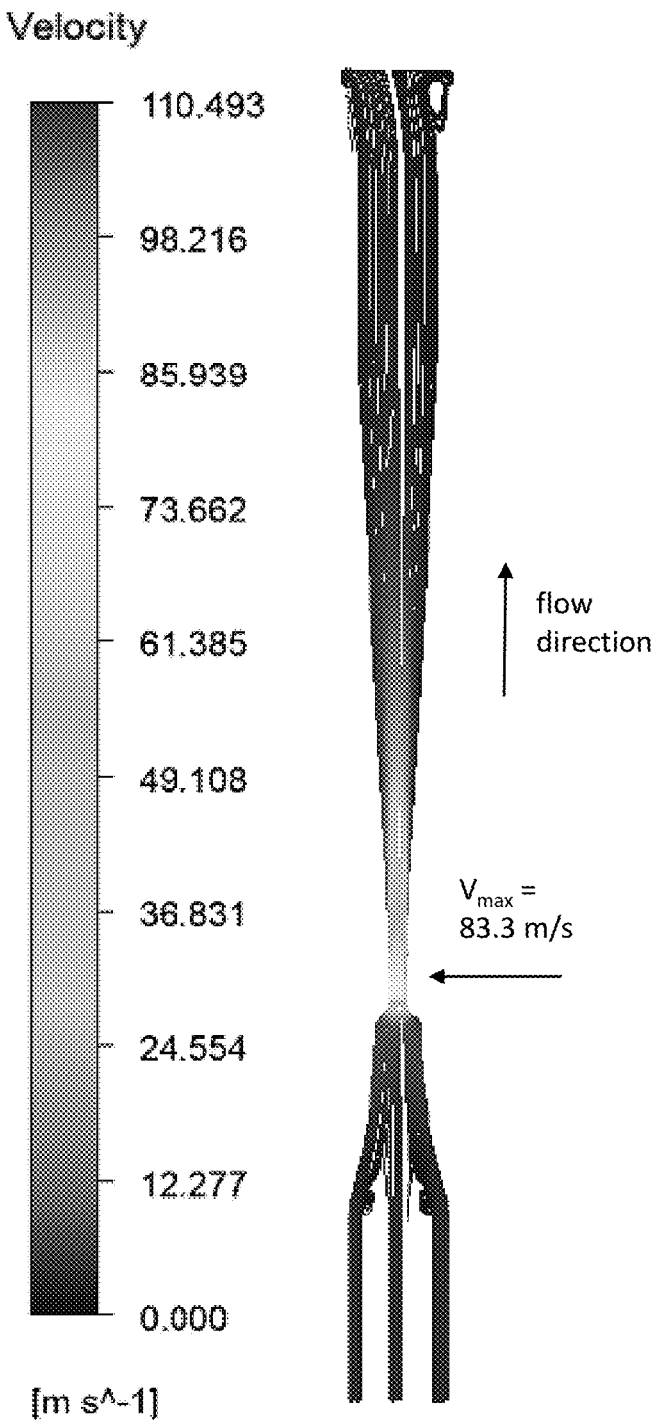
FIGS. 11A to 11D show the results of a computational fluid dynamics (CFD) model of a multiphase reservoir fluid flowing at a steady state through the device of FIG. 2 under simulated well conditions.
Figure 11B:
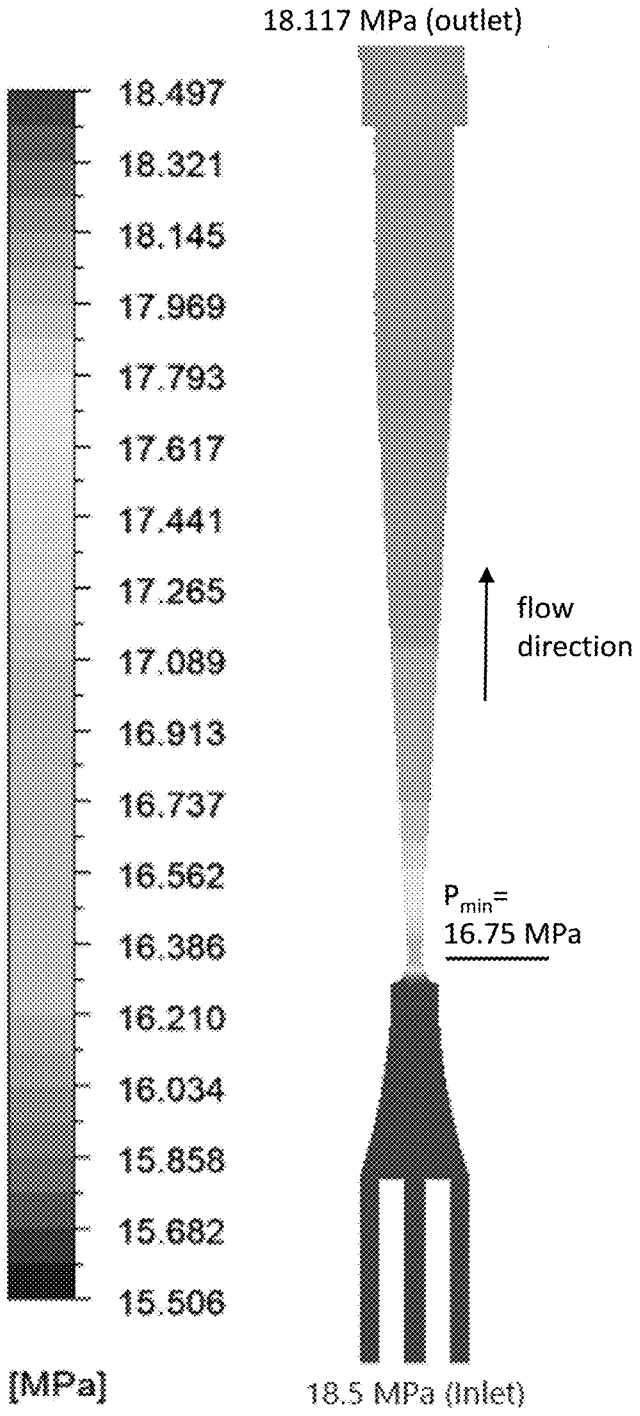
Figure 11C:
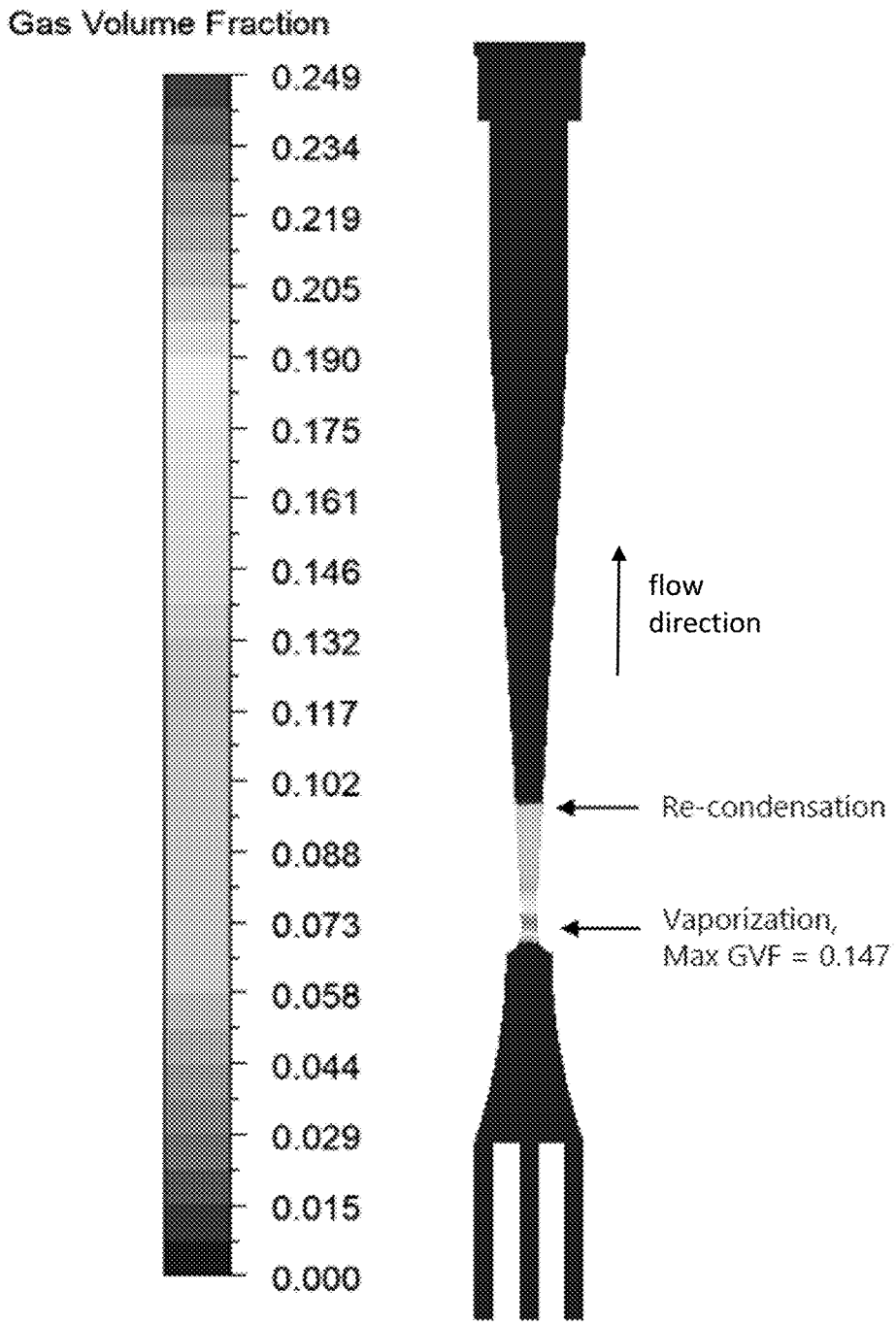
Figure 11D:
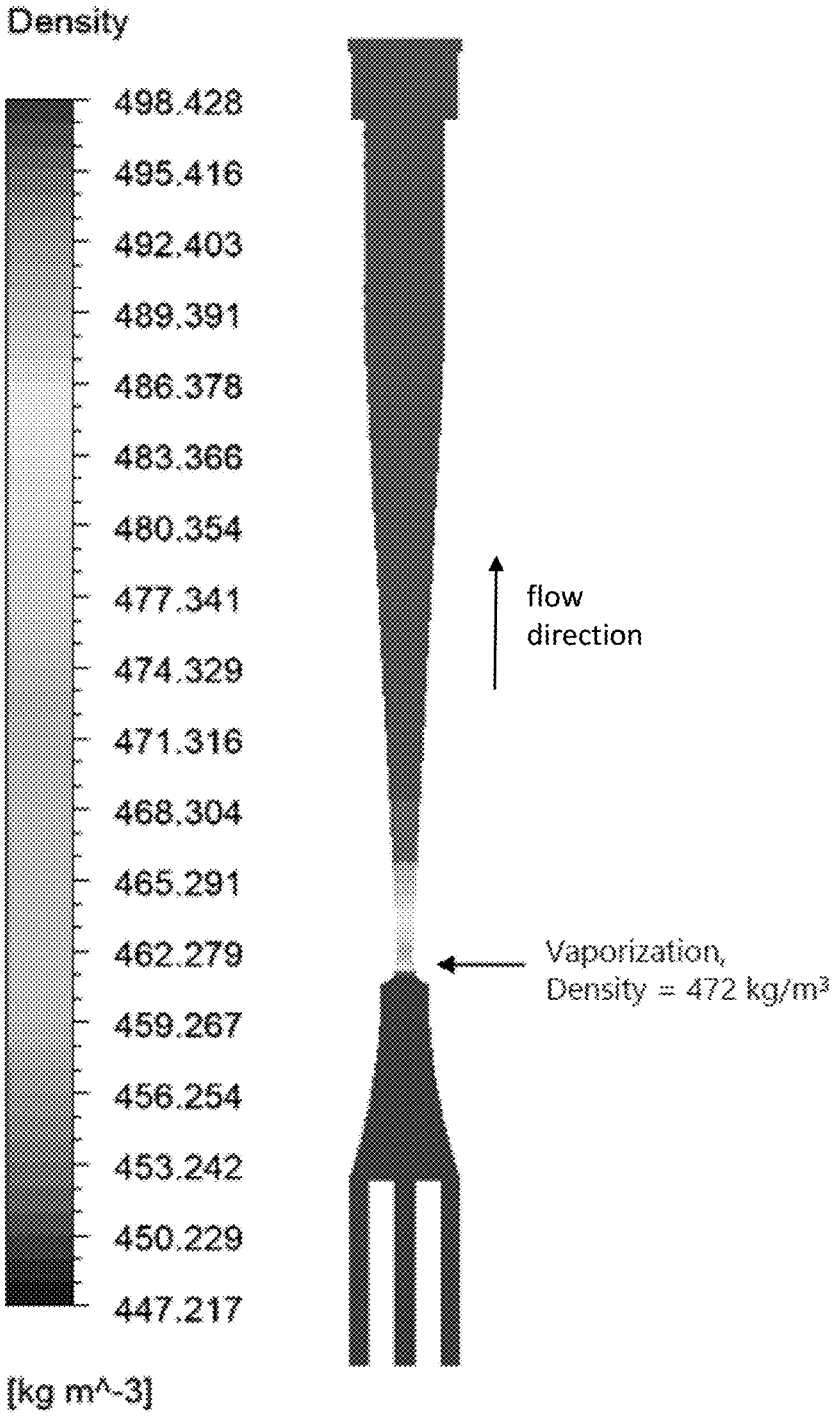

FIGS. 11A, 11B, 11C and 11D show the CFD model predictions of reservoir fluid velocity, pressure, gas volume fraction (GVF), and density, respectively, as the reservoir fluid flows at a steady state in the axial uphole direction through internal flow path 54. For FIG. 11C, "gas volume fraction" or "GVF" refers to the ratio of the volume of the gas phase (if any) of the reservoir fluid, to the volume of the gas phase (if any) and liquid phase of the reservoir fluid volume, expressed as decimal fraction. FIG. 11A also shows streamlines of the reservoir fluid that indicate that the reservoir fluid flows with minimal turbulence throughout most of internal flow path 54.

As the reservoir fluid flows upward through the Venturi profile of internal flow path 54, the reservoir fluid velocity increases to a maximum of about 83.3 m/s (FIG. 11A), and the reservoir fluid velocity pressure decreases to a minimum of about 16.75 MPa (gauge) (FIG. 11B) at a location slightly above throat 60. This causes lighter hydrocarbons components of the reservoir fluid to "flash out", thereby increasing the reservoir fluid GVF to a maximum of 0.147 (FIG. 11C), and decreasing the reservoir fluid density to a minimum of 472 kg/m$^3$ (FIG. 11D) at this location. Device 28 allows the "flash out" phenomenon to occur at greater depth in the well than would otherwise occur in the absence of device 28. Further, the reduction in density of the reservoir fluid reduces the hydrostatic head of the column of reservoir fluid in production tubing 12. Accordingly, the device produces a "gas-lift" effect that allows for increased production of reservoir fluid from the well.

As the reservoir fluid continues to flow upward through the diffusion profile of internal flow path 54, the reservoir fluid velocity gradually decreases (FIG. 11A), and the reservoir fluid pressure gradually increases to 18.117 MPa (FIG. 11B) at upper outlet port 58. Almost all or all of the free gas phase condenses to the liquid phase at a location substantially below upper outlet port 58 (see FIG. 11C at the point labelled "re-condensation"). Accordingly, the gas-lift effect is not impacted or only minimally impacted by free gas above the upper outlet port 58.

Figure 11E:
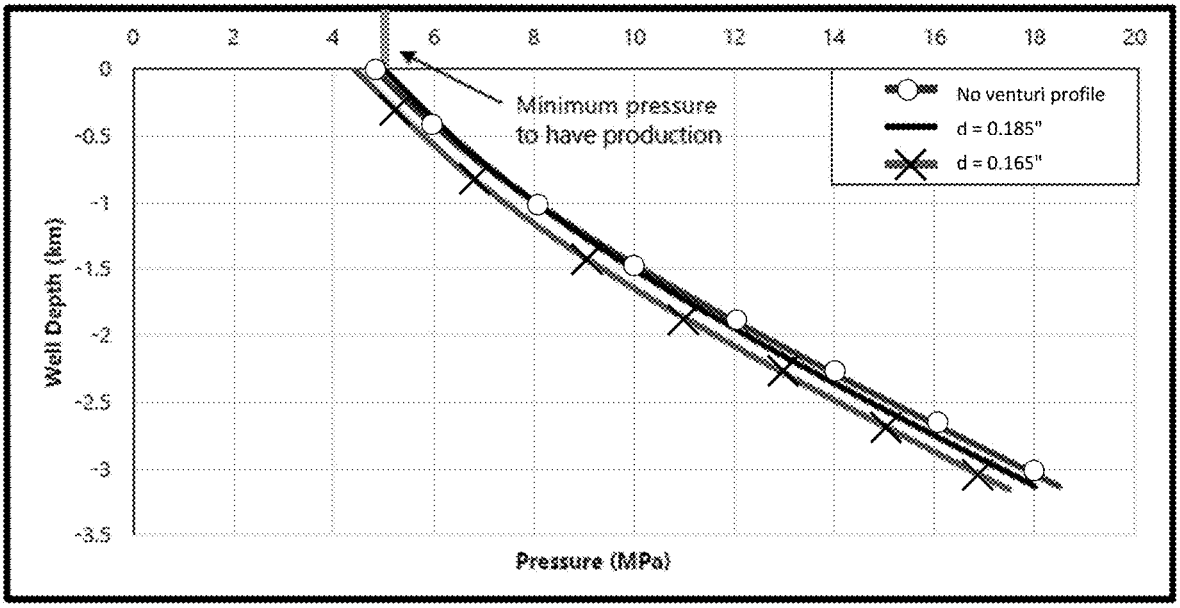
FIG. 11E shows the effect of the Venturi profile and the throat diameter thereof on reservoir fluid pressure over the well depth.

In the foregoing example, the throat diameter 'd' is set to 0.185 inches. FIG. 11E shows the effect of modifying the throat section 36 with a section having no Venturi profile, or a throat diameter of 0.165 inches, as predicted by the CFD model. In the case of no Venturi profile, the predicted reservoir fluid pressure at the well head is only 4.8 MPa. As this is less than the modeled pressure of 5 MPa at the well head separator, the well would be non-producing. In the case of a throat section 36 having a throat diameter of 0.165 inches, the throat section 36 results in reservoir fluid pressure drop being so large, that the predicted reservoir pressure at the well head is only 4.4 MPa. Again, the well would be non-producing. If the throat diameter is further decreased, throat section 36 may choke the flow of reservoir fluid.

Interpretation. The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The claimed invention is:

1. A device for lifting a reservoir fluid in an oil and gas well, the device comprising a tubular member for forming a portion of a production tubing disposed in the well, wherein the tubular member defines an internal flow path for flow of the reservoir fluids in an axial uphole direction and comprises:

(a) a Venturi profile having a transverse cross-sectional area that gradually decreases in the axial uphole direction to a throat, the Venturi profile configured to flash out a free gas phase from the reservoir fluid as the reservoir fluid flows in the axial uphole direction through the Venturi profile, such that the reservoir fluid comprises the free gas phase and a liquid phase;

(b) a diffusion profile disposed above the throat of the Venturi profile and having a transverse cross-sectional area that gradually increases in the axial uphole direction, the diffusion profile configured to condense the free gas phase into the liquid phase as the reservoir fluid flows in the axial uphole direction through the diffusion profile; and (c) an inlet port section defining a plurality of inlet ports, each having an axis aligned with the axial uphole direction, wherein the plurality of inlet ports comprises at least one central inlet port and a plurality of spaced apart peripheral inlet ports.

2. The device of claim 1, wherein the plurality of inlet ports each has an axial length to transverse dimension ratio of at least about 9 to 1.

3. The device of claim 1, wherein the internal flow path further comprises an inlet chamber profile disposed axially between at least one inlet port, of the plurality of input ports, and the Venturi profile, and having a transverse cross-sectional area that gradually decreases in the axial uphole direction.

4. The device of claim 1, wherein the tubular member comprises:

(a) a housing;

(b) an inlet chamber section removably retained in the housing and defining a first portion of the internal flow path comprising the Venturi profile; and (c) a throat section removably retained in the housing and defining a second portion of the internal flow path comprising the diffusion profile.

5. A system for lifting a reservoir fluid in an oil and gas well, the system comprising a production tubing disposed in the well and defining an internal flow path for flow of the reservoir fluid, wherein the internal flow path extends in an axial uphole direction and comprises:

(a) a Venturi profile having a transverse cross-sectional area that gradually decreases in the axial uphole direction to a throat, the Venturi profile configured to flash out a free gas phase from the reservoir fluid as the reservoir fluid flows in the axial uphole direction through the Venturi profile, such that the reservoir fluid comprises the free gas phase and a liquid phase; and (b) a diffusion profile disposed above the throat of the Venturi profile and having a transverse cross-sectional area that gradually increases in the axial uphole direction, the diffusion profile configured to condense the free gas phase into the liquid phase as the reservoir fluid flows in the axial uphole direction through the diffusion profile; and (c) a lower inlet section defining a plurality of lower inlet ports, each having an axis aligned with the axial uphole direction wherein the plurality of lower inlet ports comprises a central lower inlet port and a plurality of spaced apart peripheral inlet ports.

6. The system of claim 5, wherein at least one inlet port, of the plurality of input ports, has an axial length to transverse dimension ratio of at least about 9 to 1.

7. The system of claim 5, wherein the internal flow path further comprises an inlet chamber profile disposed axially between at least one inlet port, of the plurality of input ports, and the Venturi profile, and having a transverse cross-sectional area that gradually decreases in the axial uphole direction.

8. The system of claim 5, wherein the production tubing comprises:

(a) a housing;

(b) an inlet chamber section removably retained in the housing and defining a first portion of the internal flow path comprising the Venturi profile; and (c) a throat section removably retained in the housing and defining a second portion of the internal flow path comprising the diffusion profile.

* * * * *